US011293634B2

(12) United States Patent
Brown

(10) Patent No.: US 11,293,634 B2
(45) Date of Patent: Apr. 5, 2022

(54) CONTAINER APPARATUS AND METHOD OF USING SAME

(71) Applicant: FUSE, LLC, Memphis, TN (US)

(72) Inventor: Matthew S. Brown, Falkner, MS (US)

(73) Assignee: FUSE, LLC, Memphis, TN (US)

( * ) Notice: Subject to any disclaimer, the term of this patent is extended or adjusted under 35 U.S.C. 154(b) by 0 days.

(21) Appl. No.: 17/126,419

(22) Filed: Dec. 18, 2020

(65) Prior Publication Data

US 2021/0190307 A1 Jun. 24, 2021

Related U.S. Application Data

(60) Provisional application No. 62/949,858, filed on Dec. 18, 2019.

(51) Int. Cl.

| | |
|---|---|
| ***F21V 33/00*** | (2006.01) |
| ***A47G 23/02*** | (2006.01) |
| ***F21L 4/00*** | (2006.01) |
| ***F21V 23/04*** | (2006.01) |
| ***F21V 17/10*** | (2006.01) |

(52) U.S. Cl.

CPC ..... *F21V 33/0036* (2013.01); *A47G 23/0241* (2013.01); *A47G 23/0266* (2013.01); *F21L 4/005* (2013.01); *F21V 17/105* (2013.01); *F21V 23/04* (2013.01); *A47G 2200/08* (2013.01); *A47G 2200/10* (2013.01)

(58) Field of Classification Search

CPC .... F21V 33/0036; F21V 23/04; F21V 17/105; A47G 23/0241; A47G 23/0266; F21L 4/005

See application file for complete search history.

(56) References Cited

U.S. PATENT DOCUMENTS

| | | | |
|---|---|---|---|
| 4,871,597 | A | 10/1989 | Hobson |
| 4,886,183 | A | 12/1989 | Fleming |
| 5,119,279 | A | 6/1992 | Makowsky |
| 5,207,076 | A | 5/1993 | Sciarrillo |
| 5,415,305 | A | 5/1995 | Drake-Tipton et al. |
| 5,969,592 | A | 10/1999 | Reed |
| 6,092,905 | A | 7/2000 | Koehn |
| 6,158,870 | A | 12/2000 | Ramirez |
| 6,286,709 | B1 | 9/2001 | Hudson |
| 6,786,614 | B2 | 9/2004 | Ciarrocchi, Jr. |
| D516,875 | S | 3/2006 | Hicks et al. |
| 7,021,594 | B2 | 4/2006 | Exler |
| D533,751 | S | 12/2006 | Exler |
| D547,618 | S | 7/2007 | Exler |
| 7,922,031 | B1 | 4/2011 | Prince |
| 8,334,780 | B1 | 12/2012 | Mendoza, Jr. |
| 8,752,726 | B2 | 6/2014 | Molz |
| 8,870,018 | B2 | 10/2014 | Cook et al. |
| 9,568,186 | B2 | 2/2017 | Brown |
| 9,671,158 | B1 | 6/2017 | Sandberg et al. |
| 10,827,863 | B2 | 11/2020 | Brown et al. |

(Continued)

*Primary Examiner* — Thomas M Sember

(74) *Attorney, Agent, or Firm* — Ashley Law Firm P.C.; Stephen S. Ashley, Jr.

(57) ABSTRACT

A container apparatus can receive and hold a beverage container such as a beverage can or bottle. The apparatus can include a light assembly and can be used as a flashlight. A magnet can be positioned on the outer surface of the apparatus, and the apparatus can be magnetically attached to a metal support structure.

20 Claims, 11 Drawing Sheets

(56) References Cited

U.S. PATENT DOCUMENTS

| | | | | |
|---|---|---|---|---|
| 2006/0196218 | A1 | 9/2006 | Mogil | |
| 2008/0285621 | A1 | 11/2008 | Rowen | |
| 2012/0002400 | A1 | 1/2012 | Lindholm | |
| 2012/0176782 | A1* | 7/2012 | VanderSchuit | F21V 14/08 362/184 |
| 2013/0168399 | A1 | 7/2013 | Harrison-Griffin | |
| 2015/0077975 | A1 | 3/2015 | Brown | |
| 2015/0182046 | A1 | 7/2015 | Walsh | |
| 2015/0366383 | A1 | 12/2015 | Raunio et al. | |
| 2016/0010845 | A1 | 1/2016 | Brown | |
| 2021/0052097 | A1 | 2/2021 | Brown et al. | |

* cited by examiner

CONTAINER APPARATUS AND METHOD OF USING SAME

CROSS REFERENCE TO RELATED APPLICATIONS

This application claims priority to U.S. Provisional Patent Application No. 62/949,858, filed Dec. 18, 2019, which is incorporated by reference herein. In addition, U.S. Pat. No. 10,827,863, U.S. Patent Application Publication No. 2020/0256547, U.S. patent application Ser. No. 17/092,626, filed Nov. 9, 2020, and U.S. Provisional Patent Application No. 62/895,718, filed Sep. 4, 2019, are incorporated herein by reference.

TECHNICAL FIELD

The present invention relates to a beverage sleeve apparatus for use on a container, such as a beverage can or bottle. One embodiment of the invention comprises a container apparatus having a releasably attached magnetic member whereby the apparatus can be magnetically attached to a support structure, such as a metal post or table.

BACKGROUND

Insulating beverage container sleeves, known as "coozies", "koozies" and/or "can huggies" are often used to hold beverage containers, such as beverage cans and bottles. The sleeves, made from an insulating material, help to maintain the beverage at the desired temperature for a longer period of time while also providing a comfortable means for the user to hold the beverage. The sleeve enables the user to hold the beverage without having to directly touch the beverage container itself, which may be very cold or hot.

SUMMARY

One object of the present invention is to provide a container apparatus for use on with a beverage container having means for releasably attaching the apparatus to a metal surface. Another object of the invention is to provide a beverage container apparatus that can also be used as a flashlight. These and other objects of the invention can be obtained in various embodiments of the invention described herein.

One embodiment of the invention comprises an apparatus adapted to hold a beverage container.

Another embodiment of the invention comprises a container apparatus that can hold a beverage container and can also be used as a flashlight.

Another embodiment of the invention comprises a container apparatus having a magnetic member and a light emitting device releasably attached to the container body.

Another embodiment of the invention comprises a container apparatus for use with a beverage container comprising means for releasable attachment to a cord, strap, rope or like member.

A container apparatus according to an embodiment of the invention comprises a container body adapted for receiving a beverage container, the container body having a top end defining an opening in the container body for receiving the beverage container and a base end opposite the top end. A magnetic member having magnetic properties can be positioned proximate the base end of the container body whereby the apparatus can be magnetically attached to a structure comprised of a magnetic material.

According to an embodiment of the invention, the magnetic member can be comprised of ceramic ferrite or samarium cobalt.

According to an embodiment of the invention, one or more flanges can be positioned on the outer surface of the container body. Each flange has an opening to receive and engage a complementary fastener.

According to an embodiment of the invention, the container apparatus includes a light assembly comprising a housing and at least one light emitting device contained within the housing. The light assembly housing can be releasably attached to the container body proximate the base end of the container. The housing can include a base panel, and the magnetic member can be attached to the outer surface of the base panel.

According to an embodiment of the invention, a recess is formed in the base panel and a fastening member is positioned within the recess. The fastening member is pivotably attached to the base panel, whereby the fastening member can be pivoted in and out of the recess.

According to an embodiment of the invention, the light emitting device can be a flexible printed circuit board, a light emitting diode, and/or an illuminated fiber optic cable.

According to an embodiment of the invention, the container body is comprised of transparent or translucent material.

According to an embodiment of the invention, the container body can be comprised of methyl methacrylate, thermoplastic polyurethane, and/or polymethylmethacrylate.

According to an embodiment of the invention, the container body is sized and shaped to receive the light assembly housing at the base end of the container body and frictionally engages the light assembly housing to releasably retain the light assembly housing within the container body.

According to an embodiment of the invention, the container body and the light assembly housing are substantially cylindrical.

According to an embodiment of the invention, the light assembly comprises a plurality of outer lights positioned proximate an outer edge of the light assembly housing whereby the outer lights illuminate the container body when activated.

According to an embodiment of the invention, the light assembly includes a center light positioned proximate a center of the light assembly housing and adapted to emit a beam of light whereby the apparatus can be used as a handheld flashlight when the center light is activated.

According to an embodiment of the invention, the container apparatus includes an on/off button positioned on an outer surface of the light assembly housing for turning the at least one light emitting device on and off. An opening can be formed in the container body for receiving the on/off button therethrough.

Another embodiment of the invention comprises a container apparatus comprising a container body adapted for receiving a beverage container comprising a sidewall comprising an upper sidewall section and a lower section. The upper sidewall section has a diameter larger than the lower sidewall section. The upper sidewall section has a top edge defining a top opening in the container body for receiving the beverage container and the lower sidewall section has a bottom edge defining a bottom opening in the container body. The container apparatus further comprises a light assembly comprising a housing and at least one light emitting device contained within the housing. The light assembly housing is sized and shaped to be received through the bottom opening of the container body, such that the outer surface of the light assembly housing frictionally engages the interior surface of the lower sidewall section and the light assembly housing is releasably retained within the container body.

According to an embodiment of the invention, a magnetic member having magnetic properties is positioned on the outer surface of the base of the light assembly housing. As such, the apparatus can be magnetically attached to a structure comprised of a magnetic material.

According to an embodiment of the invention, the light assembly includes a power source contained within the light assembly housing and operatively connected to the light emitting device(s) to power the light emitting device(s).

According to an embodiment of the invention, one or more flanges can be positioned on the outer surface of the upper sidewall section. Each flange has an opening to receive and engage a complementary fastener.

According to an embodiment of the invention, a recess is formed in the outer surface of the base of the light assembly housing and a fastening member is positioned within the recess. The fastening member is pivotably attached to the base, such that the fastening member can be pivoted in and out of the recess.

According to an embodiment of the invention, the upper sidewall section and the lower sidewall section of the container body are transparent or translucent.

According to an embodiment of the invention, the upper sidewall section, the lower sidewall section, and the light assembly housing are cylindrical. A plurality of outer lights can be positioned proximate the outer edge of the light assembly housing such that the outer lights illuminate the transparent/translucent container body when activated. A center light can be positioned proximate the center of the light assembly housing, and is adapted to emit a beam of light such that the apparatus can be used as a handheld flashlight when the center light is activated.

DETAILED DESCRIPTION OF PREFERRED EMBODIMENTS

Figure 1:
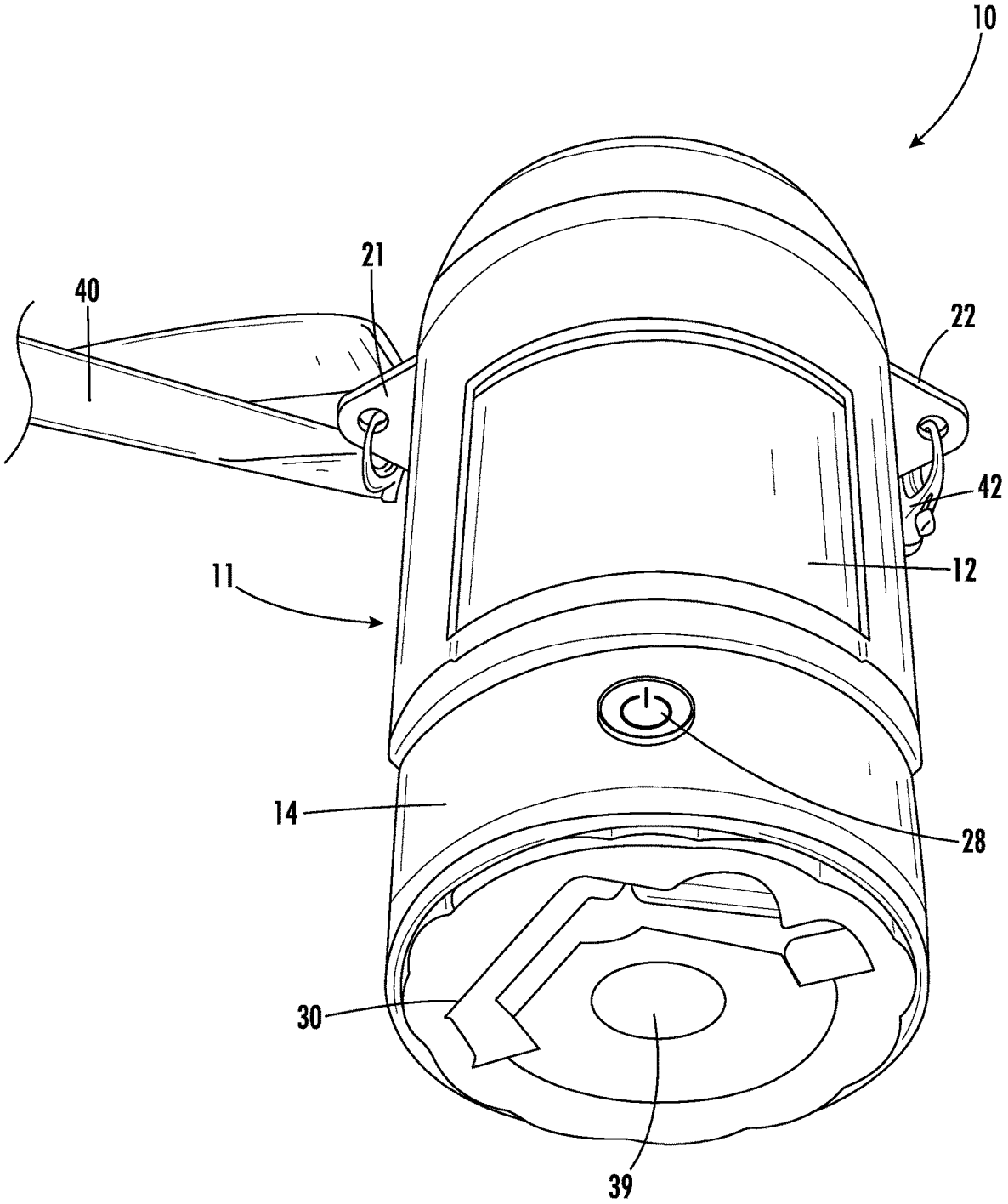
FIG. 1 is a perspective view of a container apparatus according to an embodiment of the invention.

A beverage container apparatus according to a preferred embodiment of the invention is illustrated in FIGS. 1-13 and shown generally at reference numeral 10. The container apparatus 10 comprises a substantially cylindrical body 11, and a light assembly 30 positioned at the base of the cylindrical body 11.

Figure 7:
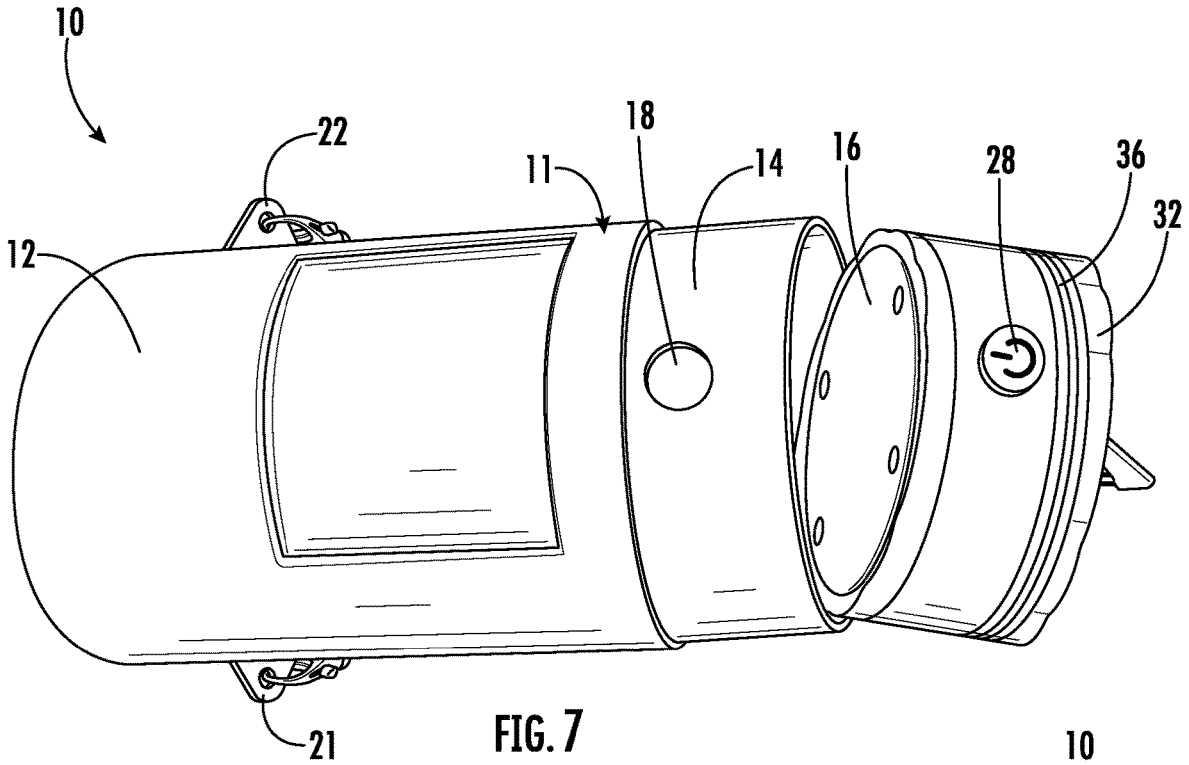
FIG. 7 is another perspective view of the apparatus of FIG. 1.
Figure 8:
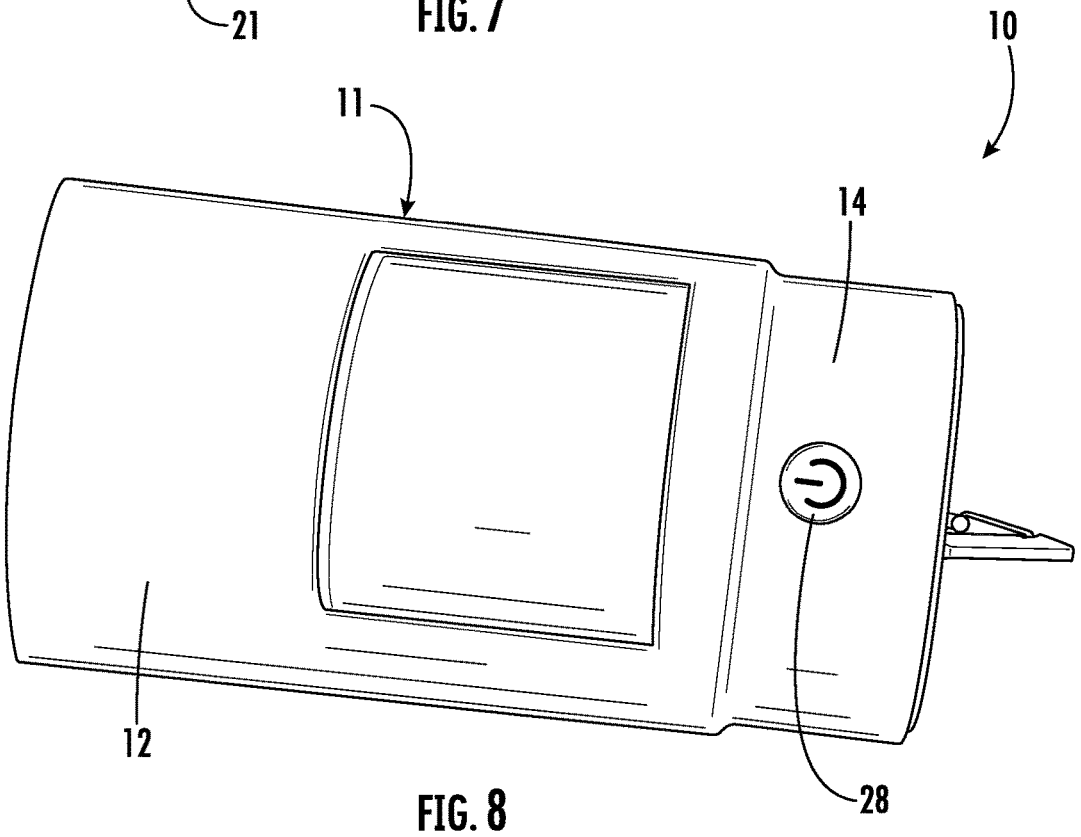
FIG. 8 is another perspective view of the apparatus of FIG. 1.

The cylindrical body 11 can comprise an upper cylindrical sidewall 12, and a lower cylindrical sidewall 14. As shown in FIGS. 1, 7 and 8, the diameter of the lower sidewall 14 is less than the diameter of the upper sidewall 12. When positioned upright, as shown in FIG. 1, the upper sidewall 12 extends upwardly from the lower sidewall 14. The upper sidewall 12 defines a circular opening at the top, which is sized to receive a conventional beverage bottle or can therethrough.

Preferably, the container body 11 is comprised of a resilient material that is transparent or translucent, such as methyl methacrylate (MMA), thermoplastic polyurethane (TPU) or polymethylmethacrylate (PMMA).

Figure 2:
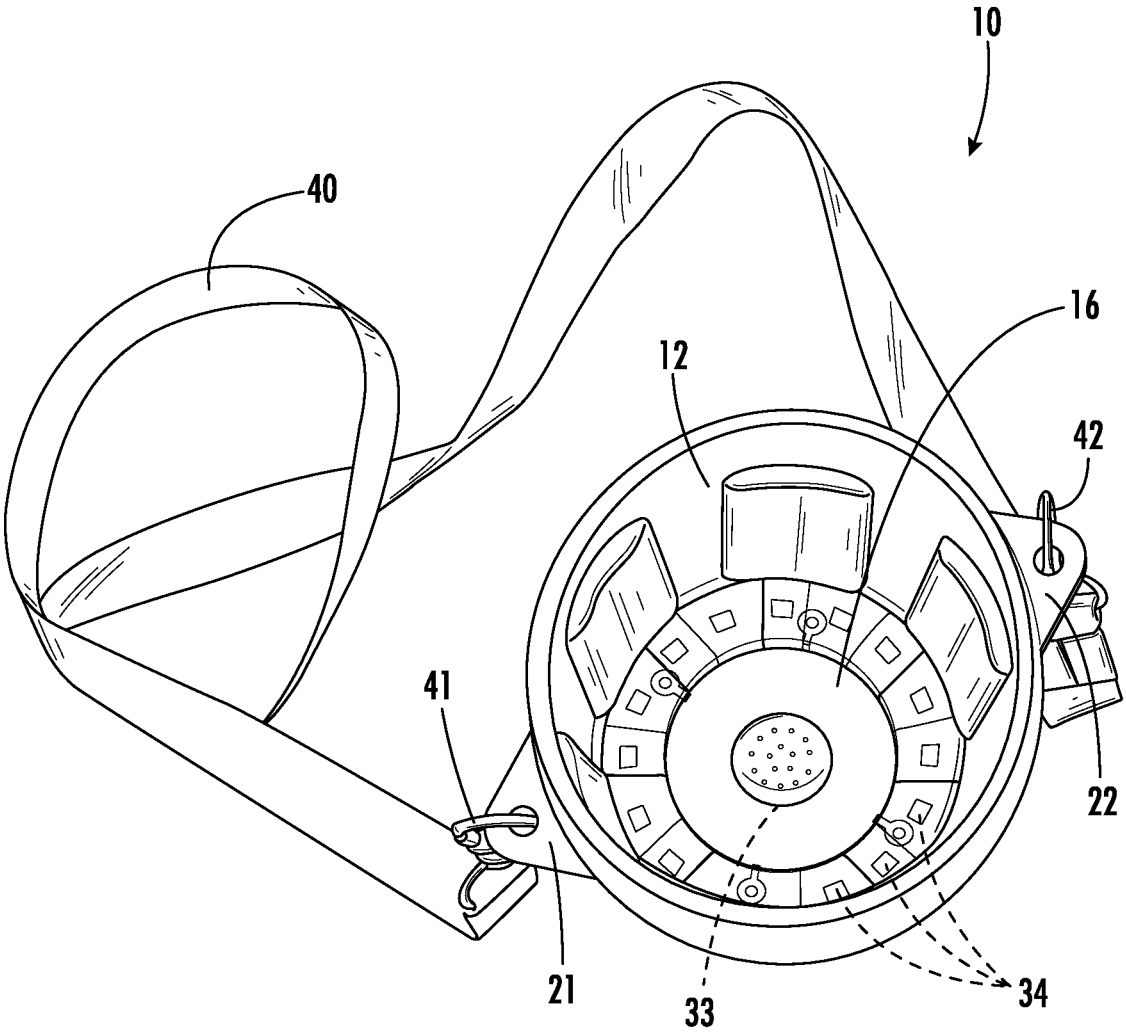
FIG. 2 is a top plan view of the apparatus of FIG. 1.

A pair of flange sections 21, 22 can extend outwardly from the outer surface of the upper sidewall 12, as shown in FIGS. 1 and 2. Each flange section 21, 22 has an opening therethrough to receive a connecting member therethrough. As shown in FIG. 2, the connecting member can be a strap 40 with fasteners such as hook clasps 41, 42 attached at opposite ends of the strap 40. Alternatively, the fasteners can be bolt snaps. The clasps 41, 42 are positioned through the openings formed in the flange sections 21, 22, respectively, as shown in FIG. 2.

Figure 3:
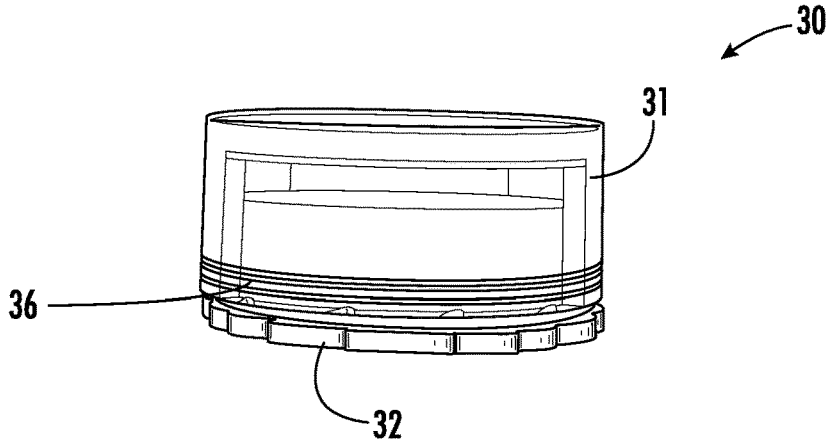
FIG. 3 is a perspective view of the light assembly of the apparatus of FIG. 1.
Figure 4:
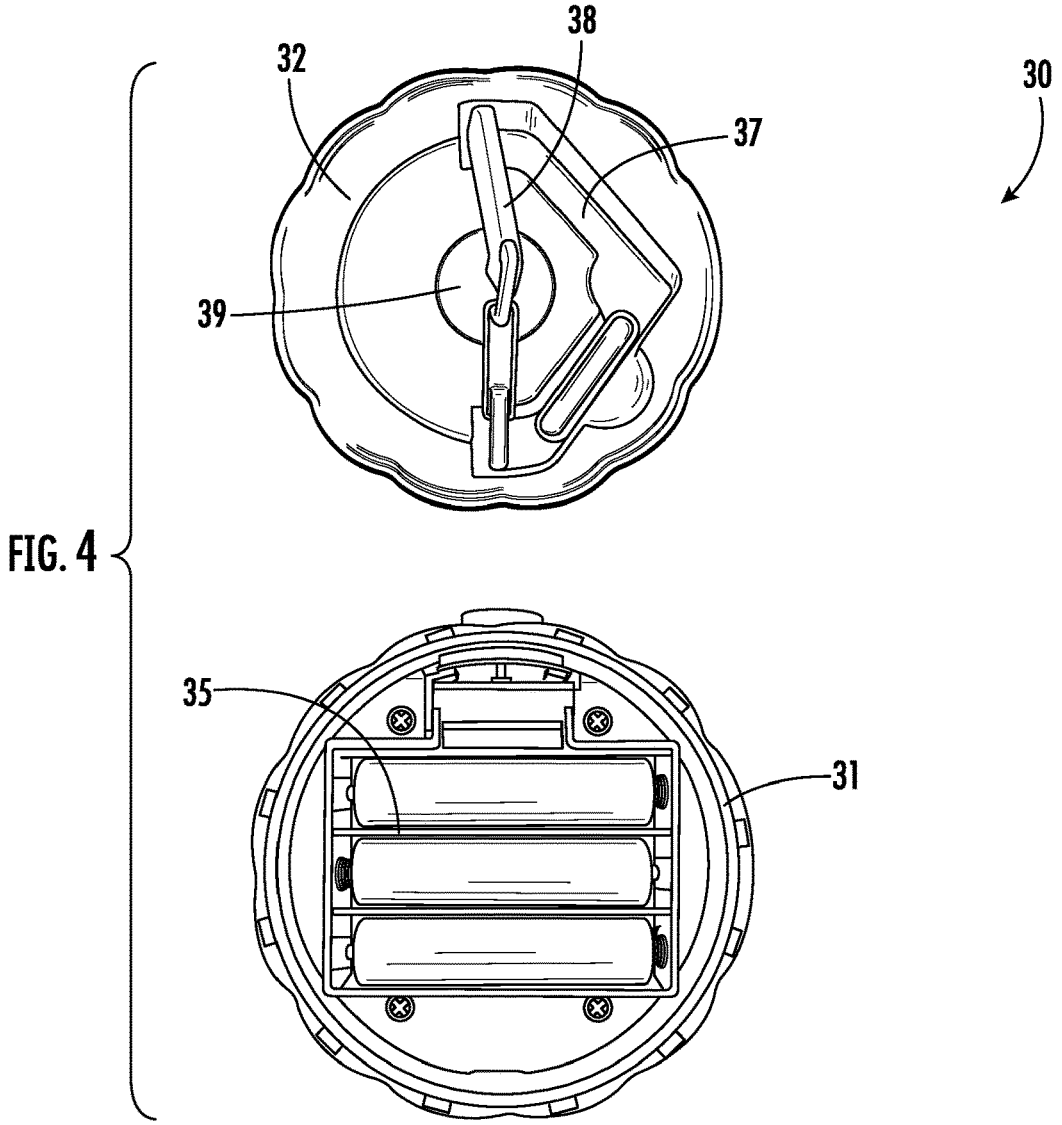
FIG. 4 is an exploded perspective view of the light assembly of FIG. 3.
Figure 5:
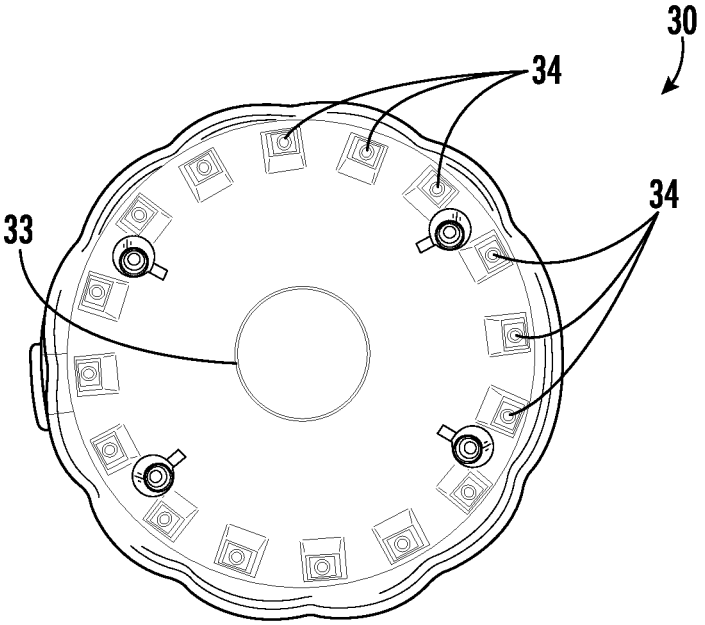
FIG. 5 is a top view of the light assembly of FIG. 3.
Figure 6:
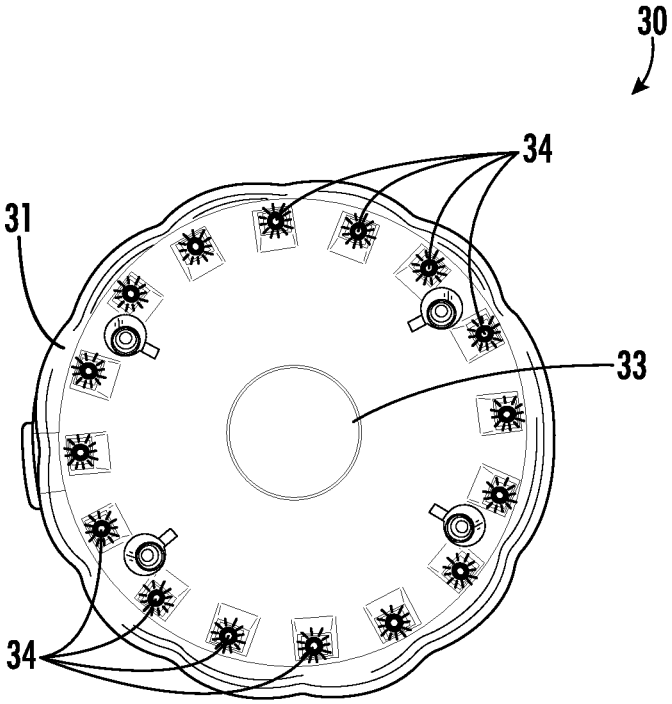
FIG. 6 is another light assembly of FIG. 3.

As shown in FIGS. 3 and 4, the light assembly 30 comprises a cylindrical body 31 releasably attached to a circular base panel 32. As shown in FIGS. 5 and 6, a plurality of outer lights 34 can be positioned proximate the outer edge of the upper surface of the light assembly 30. Preferably, the outer lights 34 are multi-colored light emitting diodes (LED). A center light 33 can be positioned proximate the center of the upper surface of the light assembly 30, a shown in FIGS. 5 and 6. The light assembly 30 contains a power source operatively connected to the center light 33 and outer lights 34 to power the lights 33, 34. The power source can be one or more batteries, such as three AA sized batteries 35, as shown in FIG. 4. As shown in FIG. 3, threads 36 can be formed on a portion of the outer surface of the body 31 that engage in complementary fashion with threads formed on an inner surface of the base panel 32, such that the base panel 32 can be screwed on and off of the light assembly body 31. The base panel 32 can be screwed off the body 31 to expose the interior of the body 31 to replace batteries as needed, as shown in FIG. 4.

A top panel 16 can be attached to the light assembly 30 opposite the base panel 32, as shown in FIG. 7. The top panel 16 is comprised of a transparent or translucent material. When the light assembly is positioned within the container body 11, the top panel 16 is positioned between the upper sidewall 12 and the lower sidewall 14 and can serve as a floor wall that can support a bottle, can or other beverage container positioned within the apparatus 10. When positioned upright, the upper sidewall 12 extends upwardly from the panel 16 and the lower sidewall 14 extends downwardly from the panel. In an alternative embodiment, the panel 16 can be integrally formed as part of the container body 11, rather than attached to the light assembly 30.

As shown in FIGS. 1, 7 and 8, the light assembly 30 is positioned within the lower side wall 14 and against the floor wall 16 of the container body 11, with the lights 33, 34 adjacent the floor wall 16. The light assembly 30 can be sized and shaped such that it is held within the container body 11 by frictional engagement between the light assembly body 31 and the inner surface of the lower sidewall 14.

Figure 9:
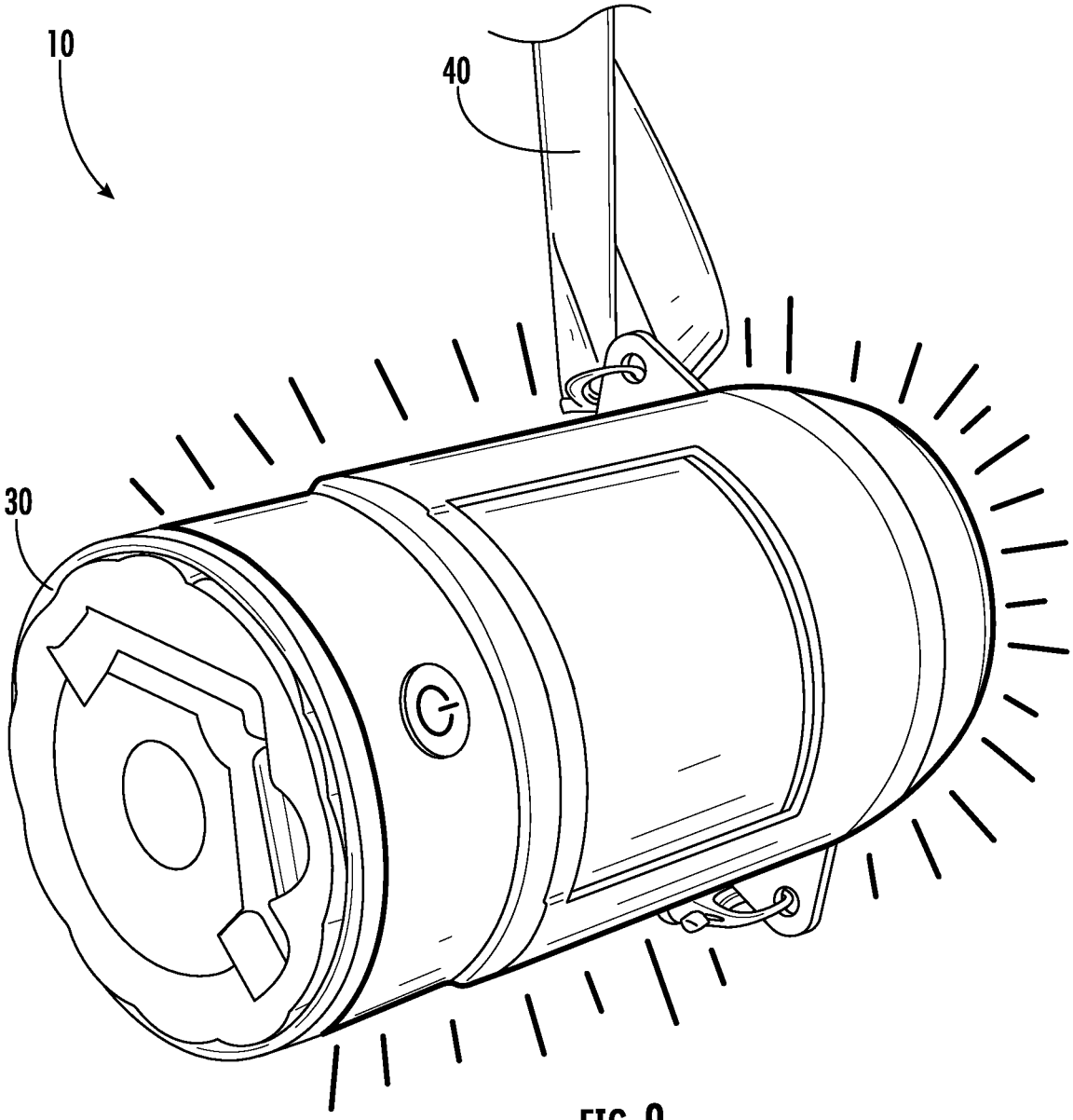
FIG. 9 is another perspective view of the apparatus of FIG. 1.

When the outer lights 34 are activated, shown in FIG. 6, the outer lights 34 transmit light throughout the transparent/translucent body 11, lighting up the container body 11, as shown in FIG. 9. When the center light 33 is activated, a beam of white light emanates from the apparatus 10, and the apparatus 10 can be used as a hand-held flashlight.

The light assembly 30 includes means for turning the lights 32, 33 on and off. The light assembly can include an on/off button 28 on the outer surface of the light assembly body 31, as shown in FIGS. 1, 7 and 8. An opening 18 can be formed in the lower sidewall 14 of the container body 11, and the on/off button 28 can be positioned through the opening 18, as shown in FIGS. 7 and 8. The light assembly 30 can be programmed such that pressing the on/off button 28 sequentially activates and/or deactivates the various functions of the lights 33, 34. For example, pressing the button 28 once can activate the outer lights 34. Pressing the button 28 a second time can deactivate the outer lights 34 and activate the center light 33. Pressing the button 28 a third time can outer lights 34, so both the outer lights 34 and the center light 34 are on. Pressing the button 28 a fourth time can deactivate both the outer lights 34 and the center light 33.

Figure 10:
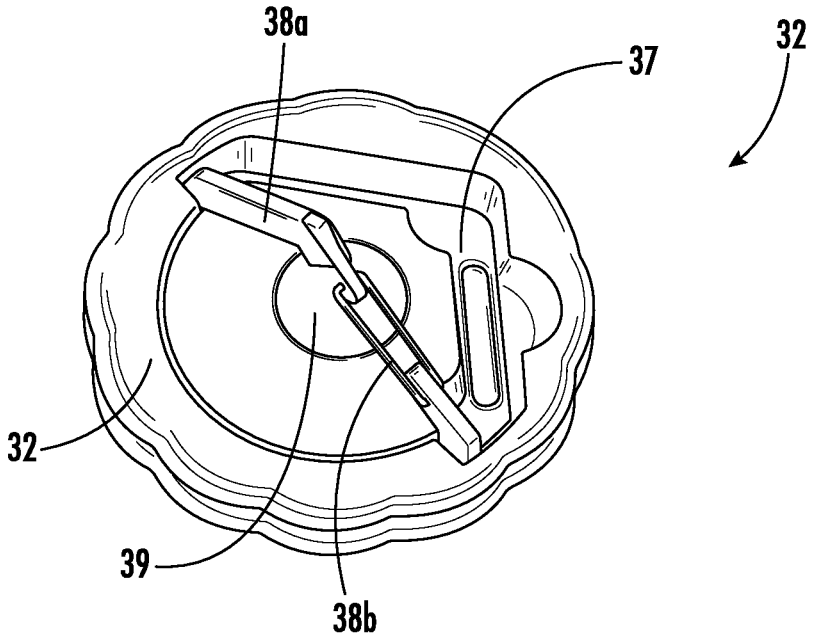
FIG. 10 is a partial perspective view of the light assembly of FIG. 3.
Figure 11:
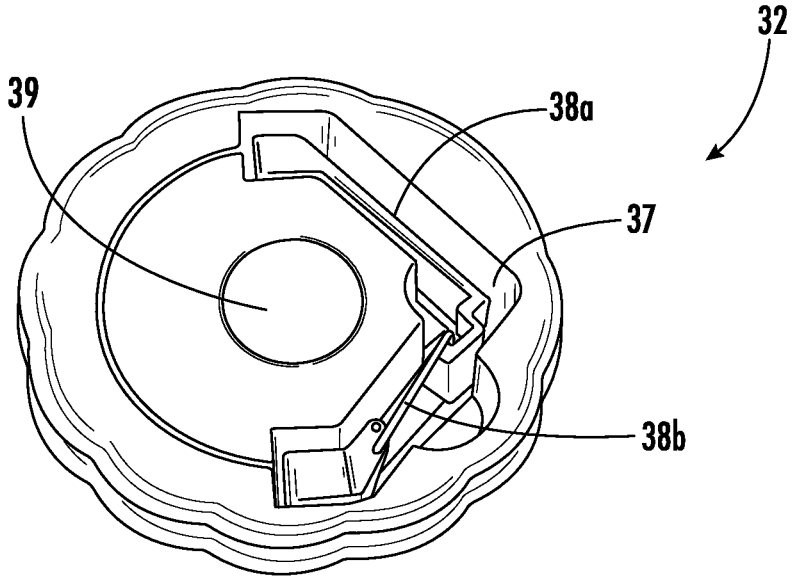
FIG. 11 is another partial perspective view of the light assembly of FIG. 3.
Figure 12:
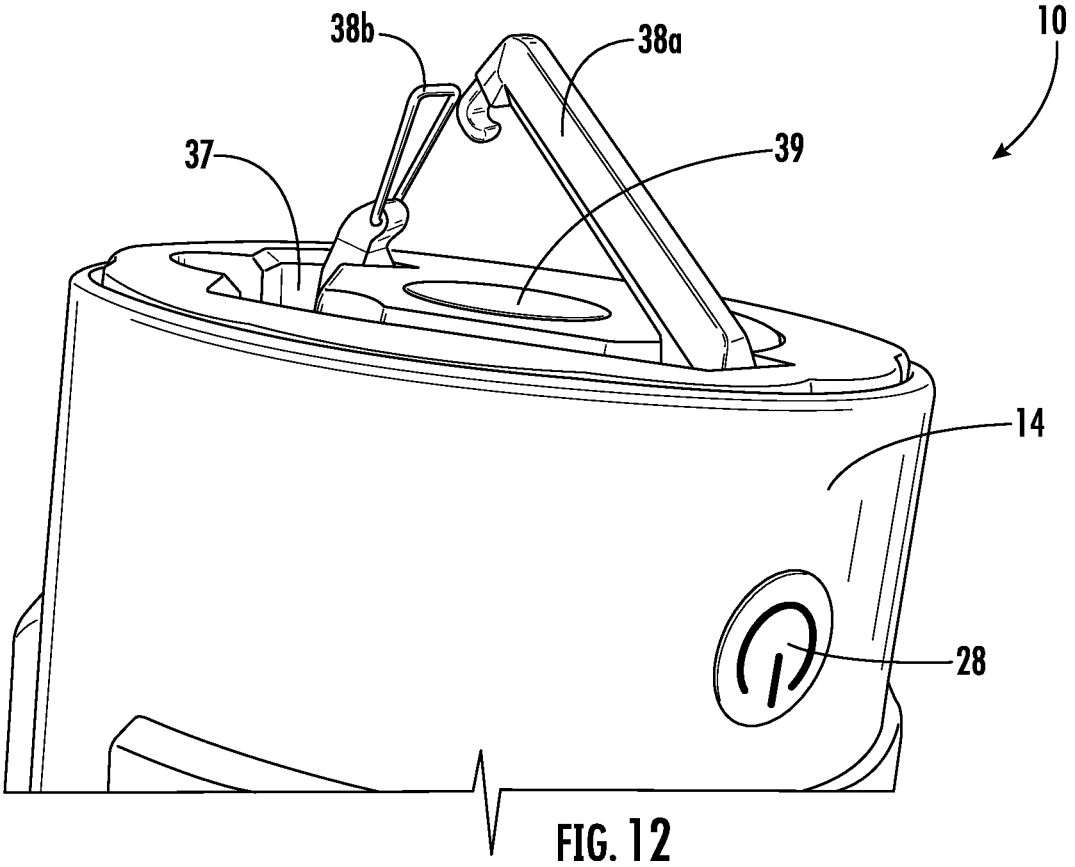
FIG. 12 is a partial perspective view of the apparatus of FIG. 1.
Figure 13:
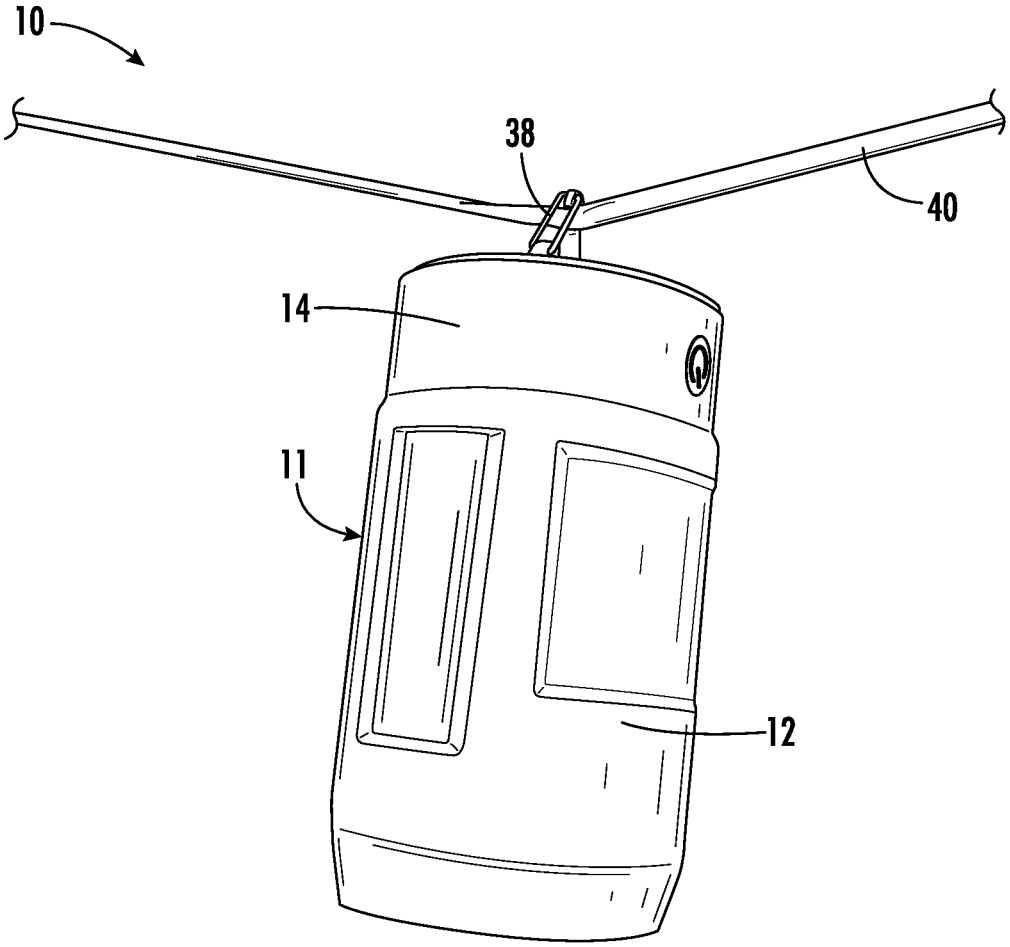
FIG. 13 is an environmental perspective view of the apparatus of FIG. 1.

The apparatus 10 can include means for hanging the apparatus on a rope, cable, cord, string or other like connecting member. A recess 37 can be formed in the bottom surface of the base panel 32, and a fastening member such as a hanger clip 38 is positioned within the recess 37, as shown in FIGS. 10 and 11. The hanger clip 38 can be comprised of a hook member 38*a* that can be releasably attached to a loop member 38*b*, as shown in FIGS. 10-12. The hook member 38*a* and loop member 38*b* are each pivotably attached to the base panel 32. The hook member 38*a* and loop member 38*b* can be pivoted outwardly from the base panel 32, as shown in FIGS. 10 and 12. The strap 40 can be detached from the flange sections 21, 22, and positioned under the hanger clip 38 so the apparatus 10 hangs from the cord 40, as shown in FIG. 13.

Figure 14:
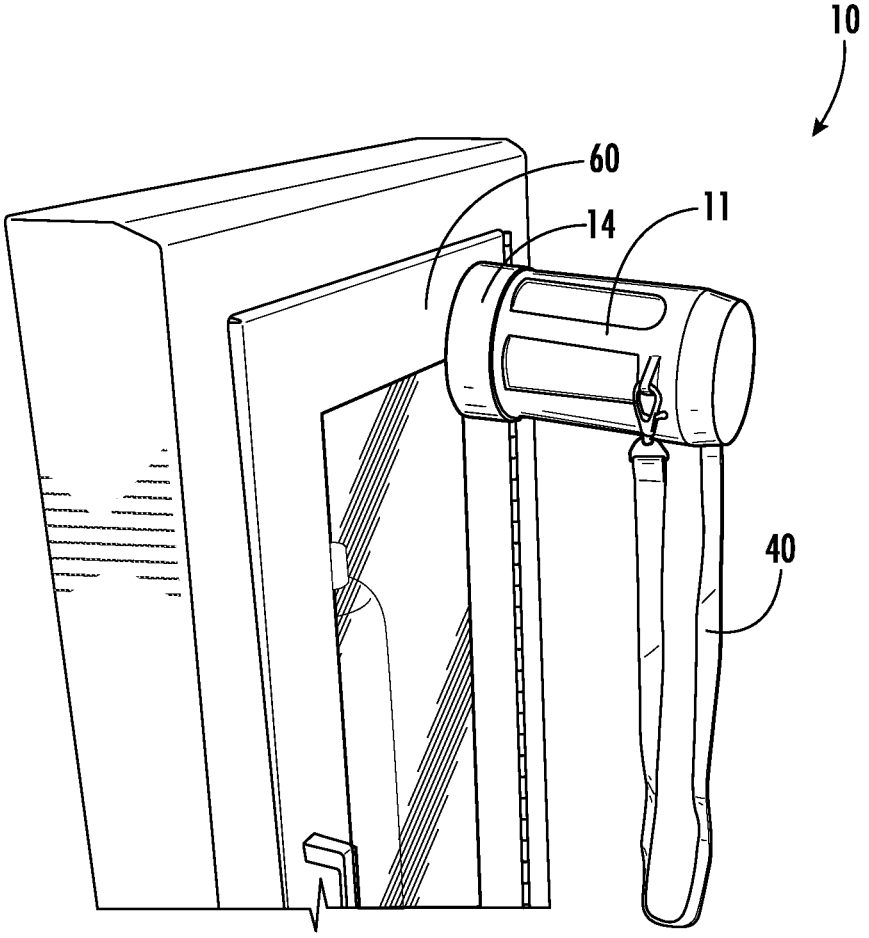
FIG. 14 is another environmental perspective view of the apparatus of FIG. 1.
Figure 15:
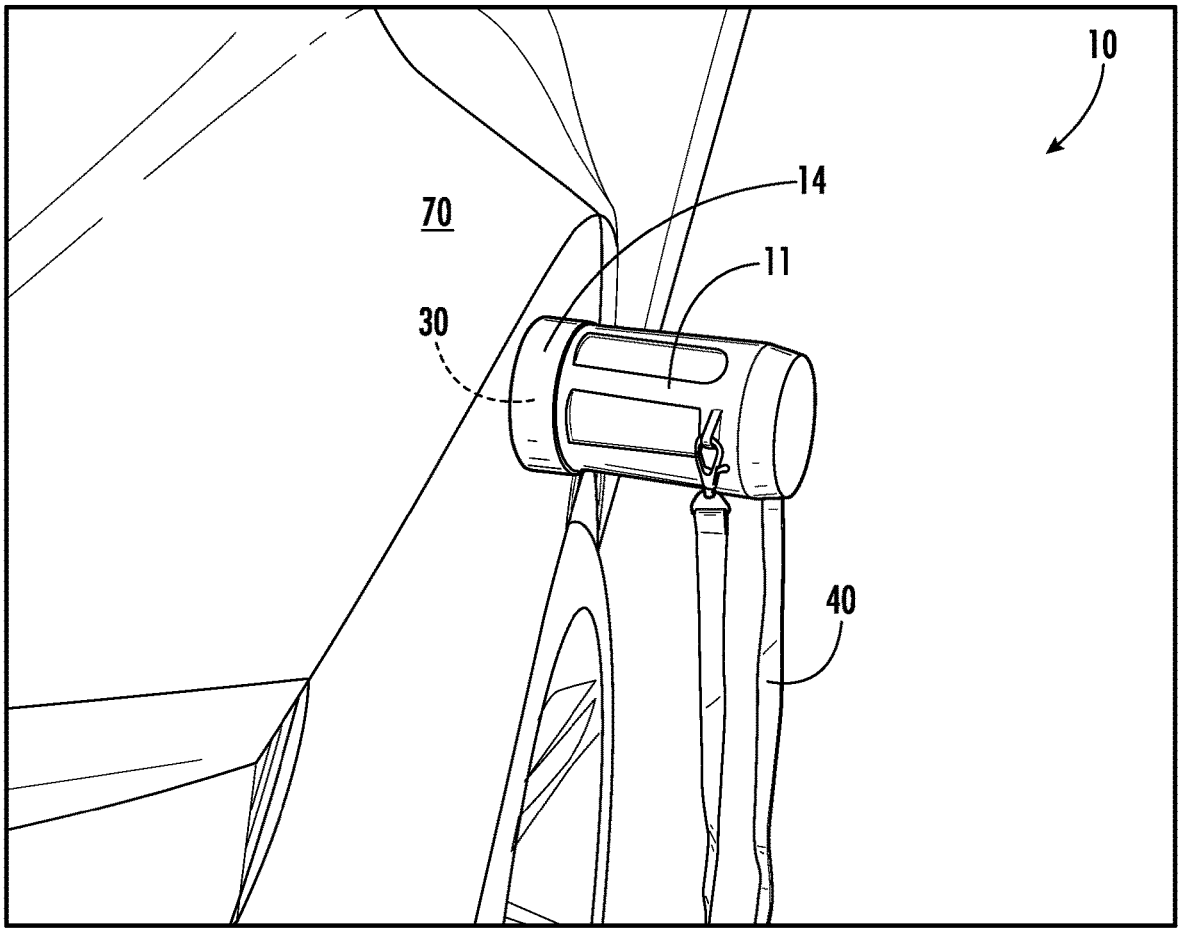
FIG. 15 is another environmental perspective view of the apparatus of FIG. 1.

The base panel 32 can include a magnetic member 39 positioned at the center of the outer surface of the base panel 32, as shown in FIGS. 1 and 11. The magnetic member 39 is comprised of a material having magnetic properties. The magnetic member 39 can be comprised of ceramic ferrite, samarium cobalt or other suitable magnetic material. As such, the container 10 can be magnetically attached to a support structure made of a material that is attracted to magnets. For example, the apparatus 10 can be magnetically attached to the surface of a metal case 60, as shown in FIG. 14. In another example, the apparatus 10 can be magnetically attached to the body of an automobile 70, as shown in FIG. 15.

A container apparatus and method of using same are described above. Various changes can be made to the invention without departing from its scope. The above description of the preferred embodiments and best mode of the invention are provided for the purpose of illustration only and not limitation—the invention being defined by the claims.

What is claimed is:

1. A container apparatus comprising:

(a) a container body adapted for receiving a beverage container, the container body having a top end defining an opening in the container body for receiving the beverage container and a base end opposite the top end;

(b) a magnetic member positioned proximate the base end of the container body, the magnetic member comprised of a material having magnetic properties whereby the apparatus can be magnetically attached to a structure comprised of a magnetic material; and (c) at least one flange positioned on the outer surface of the container body and having an opening formed therethrough to receive and engage a complementary fastener.

2. The apparatus according to claim 1, wherein the magnetic member is comprised of at least one material selected from the group consisting of ceramic ferrite and samarium cobalt.

3. The apparatus according to claim 1, further comprising a light assembly comprising a housing and at least one light emitting device contained within the housing, the housing releasably attached to the container body proximate the base end of the container, the housing comprising a base panel, and wherein the magnetic member is attached to an outer surface of the base panel.

4. The container apparatus according to claim 3, wherein a recess is formed in the base panel and a fastening member is positioned within the recess and pivotably attached to the base panel, whereby the fastening member can be pivoted in and out of the recess.

5. The apparatus according to claim 3, wherein the light emitting device comprises at least one selected from the group consisting of a flexible printed circuit board, a light emitting diode, and an illuminated fiber optic cable.

6. The apparatus according to claim 3, wherein the container body is comprised of at least one material selected from the group consisting of methyl methacrylate, thermoplastic polyurethane, and polymethylmethacrylate.

7. The apparatus according to claim 3, wherein the container body is comprised of a transparent or translucent material.

8. The apparatus according to claim 7, wherein the container body is sized and shaped to receive the light assembly housing at the base end of the container body and frictionally engages the light assembly housing to releasably retain the light assembly housing within the container body.

9. The apparatus according to claim 7, wherein the container body and the light assembly housing are substantially cylindrical.

10. The apparatus according to claim 7, wherein the at least one light emitting device comprises a plurality of outer lights positioned proximate an outer edge of the light assembly housing whereby the outer lights illuminate the container body when activated.

11. The apparatus according to claim 7, wherein the at least one light emitting device comprises a center light positioned proximate a center of the light assembly housing and adapted to emit a beam of light whereby the apparatus can be used as a handheld flashlight when the center light is activated.

12. The apparatus according to claim 7, further comprising an on/off button positioned on an outer surface of the light assembly housing and operatively connected to the at least one light emitting device for turning the at least one light emitting device on and off, and wherein an opening is formed in the container body for receiving the on/off button therethrough.

13. The container apparatus according to claim 1, wherein the complementary fastener comprises a hook clasp and the hook clasp is attached to a strap.

14. A container apparatus comprising:

(a) a container body adapted for receiving a beverage container, the container body comprising a sidewall comprising an upper sidewall section and a lower sidewall section, the upper sidewall section having a diameter larger than the lower sidewall section, the upper sidewall section having a top edge defining a top opening in the container body for receiving the beverage container and the lower sidewall section having a bottom edge defining a bottom opening in the container body;

(b) a light assembly comprising a housing and at least one light emitting device contained within the housing, the light assembly housing sized and shaped to be received through the bottom opening of the container body, wherein an outer surface of the light assembly housing frictionally engages an interior surface of the lower sidewall section whereby the light assembly housing is releasably retained within the container body, and wherein a recess is formed in the outer surface of the base of the light assembly housing and a fastening member is positioned within the recess and pivotably attached to the base, whereby the fastening member can be pivoted in and out of the recess; and (c) a magnetic member positioned on an outer surface of a base of the light assembly housing, the magnetic member comprised of a material having magnetic properties whereby the apparatus can be magnetically attached to a structure comprised of a magnetic material.

15. The apparatus according to claim 14, wherein the light assembly includes a power source contained within the light assembly housing and operatively connected to the at least one light emitting device to power the at least one light emitting device.

16. The apparatus according to claim 14, further comprising at least one flange positioned on an outer surface of the upper sidewall section and having an opening to receive and engage a complementary fastener.

17. The apparatus according to claim 14, wherein the container body is comprised of a transparent or translucent material, and further wherein the upper sidewall section, the lower sidewall section, and the light assembly housing are cylindrical, and the at least one light emitting device comprises a plurality of outer lights positioned proximate an outer edge of the light assembly housing whereby the outer lights illuminate the container body when activated, and a center light positioned proximate a center of the light assembly housing and adapted to emit a beam of light whereby the apparatus can be used as a handheld flashlight when the center light is activated.

18. The container apparatus according to claim 14, wherein the fastening member comprises a hanger clip comprising a hook member releasably attached to a loop member, the hook member and the loop member pivotably attached to the base panel.

19. A container apparatus comprising:

(a) a container body adapted for receiving a beverage container, the container body having a top end defining an opening in the container body for receiving the beverage container and a base end opposite the top end; and (b) a magnetic member positioned proximate the base end of the container body, the magnetic member comprised of a material having magnetic properties whereby the apparatus can be magnetically attached to a structure comprised of a magnetic material;

(c) a first flange positioned on the outer surface of the container body having an opening formed therethrough to receive and releasably engage a first fastener, and a second flange positioned on the outer surface of the container body having an opening formed therethrough to receive and releasably engage a second fastener; and (d) a strap having a first end and a second end opposed to the first end, said first fastener attached to the first end of the strap and said second fastener attached to the second end of the strap, wherein the strap can be connected to the container body by positioning said first fastener in the opening formed in the first flange and positioning said second fastener in the opening formed in the second flange.

20. The container apparatus according to claim 19, wherein a recess is formed in the base panel and a fastening member is positioned within the recess and pivotably attached to the base panel, whereby the fastening member can be pivoted in and out of the recess.

* * * * *